US008465316B2

(12) United States Patent
Chung et al.

(10) Patent No.: US 8,465,316 B2
(45) Date of Patent: Jun. 18, 2013

(54) CONNECTOR, RECEPTABLE, AND CONNECTOR ASSEMBLY FOR DIGITAL BAND

(75) Inventors: Gi Soo Chung, Goyang-si (KR); Dae Hoon Lee, Seongnam-si (KR); Yeon Sang Kim, Suwon-si (KR); Jun Ho Park, Ansan-si (KR)

(73) Assignee: Korea Institute of Industrial Technology, Chungcheongnam-Do (KR)

( * ) Notice: Subject to any disclaimer, the term of this patent is extended or adjusted under 35 U.S.C. 154(b) by 0 days.

(21) Appl. No.: 13/061,186

(22) PCT Filed: Aug. 27, 2009

(86) PCT No.: PCT/KR2009/004803

§ 371 (c)(1),
(2), (4) Date: Apr. 8, 2011

(87) PCT Pub. No.: WO2010/024613

PCT Pub. Date: Mar. 4, 2010

(65) Prior Publication Data

US 2011/0318955 A1 Dec. 29, 2011

(30) Foreign Application Priority Data

Aug. 28, 2008 (KR) ..... 10-2008-0084513

(51) Int. Cl.
*H01R 4/24* (2006.01)

(52) U.S. Cl.
USPC ..... 439/344; 439/676; 439/404; 439/271

(58) Field of Classification Search
USPC ..... 439/344, 676, 465, 271, 404, 405
See application file for complete search history.

(56) References Cited

U.S. PATENT DOCUMENTS

| | | | | | |
|---|---|---|---|---|---|
| 4,040,699 | A | * | 8/1977 | Rasmussen | 439/344 |
| 4,074,928 | A | * | 2/1978 | Johnston | 439/304 |
| 4,094,571 | A | * | 6/1978 | Benjamin | 439/188 |
| 4,501,464 | A | * | 2/1985 | Bogese, II | 439/344 |
| 4,721,483 | A | * | 1/1988 | Dickie | 439/607.49 |
| 5,069,625 | A | * | 12/1991 | Brandt | 439/404 |
| 5,564,951 | A | * | 10/1996 | Attal et al. | 439/676 |

(Continued)

FOREIGN PATENT DOCUMENTS

| | | |
|---|---|---|
| CN | 1262799 A | 8/2000 |
| CN | 200980134026 | 8/2009 |

(Continued)

OTHER PUBLICATIONS

PCT International Search Report and written Opinion for PCT/KR2009/004803 filed Aug. 27, 2009.

*Primary Examiner* — Gary F. Paumen
(74) *Attorney, Agent, or Firm* — Wells St. John P.S.

(57) ABSTRACT

Disclosed are a digital band connector, a receptacle, and a connector assembly for easily connecting digital bands formed of digital yarns to an external circuit. The digital band connector includes connect pins spaced apart from each other in a direction, passing through the digital bands made of digital yarns and to fix the digital bands, and electrically connected with the digital bands, a lower housing fixing the digital bands and the connect pins in a lower part and exposing one end of each of the connect pins through a lower surface, and an upper housing coupled with an upper part of the lower housing to fix the digital bands and the connect pins.

20 Claims, 4 Drawing Sheets

U.S. PATENT DOCUMENTS

| | | | | |
|---|---|---|---|---|
| 6,062,870 | A | 5/2000 | Hopfer, III et al. | |
| 6,083,052 | A | 7/2000 | Adams et al. | |
| 6,206,720 | B1 * | 3/2001 | Larkin et al. | 439/395 |
| 6,213,809 | B1 | 4/2001 | Viklund | |
| 6,398,576 | B1 * | 6/2002 | Hwang et al. | 439/354 |
| 6,848,949 | B2 * | 2/2005 | Mullaney et al. | 439/676 |
| 6,896,318 | B2 * | 5/2005 | Marrs et al. | 296/191 |
| 7,070,443 | B2 * | 7/2006 | Tashiro et al. | 439/419 |
| 7,156,687 | B1 * | 1/2007 | Chiang et al. | 439/404 |
| 7,249,961 | B1 * | 7/2007 | Provenzano | 439/409 |
| 7,611,369 | B2 * | 11/2009 | Matsunaga | 439/271 |
| 7,841,876 | B2 * | 11/2010 | Lin et al. | 439/144 |
| 7,931,503 | B2 * | 4/2011 | Zhuang | 439/676 |
| 8,128,427 | B2 * | 3/2012 | Mochizuki | 439/419 |
| 2001/0012722 | A1 * | 8/2001 | Adams | 439/418 |
| 2007/0004267 | A1 * | 1/2007 | Chiang et al. | 439/404 |
| 2008/0182103 | A1 | 7/2008 | Chung et al. | |
| 2011/0005187 | A1 | 1/2011 | Chung et al. | |

FOREIGN PATENT DOCUMENTS

| | | | |
|---|---|---|---|
| JP | 58-203387 | | 7/1985 |
| JP | 07-311827 | | 11/1995 |
| JP | 2000-294336 | | 10/2000 |
| JP | 2008-184727 | | 8/2008 |
| JP | 2011-524903 | | 9/2011 |
| KR | 20-0322064 | Y1 | 7/2003 |
| KR | 10-2004-0087772 | A | 10/2004 |
| KR | 10-0772591 | B1 | 10/2007 |
| WO | WO 2010/024813 | A2 | 3/2010 |

* cited by examiner

CONNECTOR, RECEPTABLE, AND CONNECTOR ASSEMBLY FOR DIGITAL BAND

CROSS REFERENCE TO RELATED APPLICATION

This is a 35 U.S.C. §371 application of, and claims priority to, International Application No. PCT/KR2009/004803, which was filed on Aug. 27, 2009, and which claims priority to Korean Patent Application No. 10-2008-0084513, which was filed on Aug. 28, 2008, and the teachings of all the applications are incorporated herein by reference.

TECHNICAL FIELD

The present invention relates to a connector, a receptacle, and a connector assembly for digital band, and more particularly to, a connector, a receptacle, and a connector assembly attaching a digital band made of digital yarns to an external circuit.

BACKGROUND ART

In the ubiquitous age, it is requested to access to a network in real time and to transmit and receive information anytime and anywhere. Therefore, it is necessary that digital garment that a human-being wears accesses to a peripheral network to perform such functions. As a result, digital yarns, by which weaving or knitting can be performed and by which clothes can be made while the movement of electrons can be performed so that information can be transmitted, is used.

In a conventional art, the digital yarns are connected to a connector one by one. However, in such a method, the digital yarns are to be arranged by a pitch of the connector and the digital yarns are to be connected to the connector one by one. Therefore, process time increases, effect deteriorates, and price increases. Since the diameter of the digital yarn is small, it is difficult to connect the digital yarns to the connector and the digital yarns can be cut off during a weaving or knitting process.

In order to solve such problems, digital bands, in which digital yarns are bound to be coupled with each other, are developed. The digital bands become an alternative plan for solving the above-described problems of the digital yarns.

In order to apply such digital bands to a real product, a connector electrically connecting an external circuit and the digital bands to each other is necessary. The receptacle, with which the connector can be easily coupled, is also necessary.

DISCLOSURE

Technical Problem

It is, therefore, the present invention provides a digital band connector, a receptacle, and a connector assembly easily connecting digital bands made of digital yarns to an external circuit.

Technical Solution

In accordance with an aspect of the present invention, there is provided a connector for digital bands, including: a plurality of connect pins spaced apart from each other in a direction, passing through the digital band made of a plurality of digital yarns to fix the digital bands, and electrically connected with the digital bands; a lower housing fixing the digital bands and the connect pins to a lower part and exposing one end of each of the connect pins through a lower surface; and an upper housing coupled with an upper part of the lower housing to fix the digital bands and the connect pins.

Here, the connect pins correspond to the digital yarns to be connected to the digital yarns and are electrically connected to metal units formed in the digital yarns.

The connect pins further includes piercing units fixing the digital yarns and extending units connected to the piercing units to be extended to the outside of the lower housing.

Each of the piercing units includes two vertical columns such that the digital yarns are inserted therebetween to fix the digital yarns.

A distance between the columns is shorter than a diameter of the metal units of the digital yarns.

The connect pins are arranged in one line in a longitudinal direction of the lower housing or are arranged in zigzag fashion.

Each of the digital bands is made by taping upper and lower ends of the plurality of digital yarns or by combining the same with fabrics.

One of the lower housing and the upper housing further includes at least one protrusion formed on a surface of the lower housing or the upper housing to be coupled with the digital bands.

The lower housing includes through holes in a lower part thereof so that the connect pins penetrate the through holes and are exposed to a lower surface of the lower housing through the through holes.

In accordance with an aspect of the present invention, there is provided a receptacle, including: a plurality of conductive patterns, each one end of which is connected to an external circuit; a lower housing including a plurality of through holes penetrated by the other ends of the conductive patterns to support the other ends of the conductive patterns from a lower part of the lower housing; and an upper housing coupled with an upper part of the lower housing to define a space between the upper housing and the lower housing, wherein a digital band connector connected to digital bands is inserted into the space so that the digital band connector is electrically connected to the conductive patterns.

Each of the lower housing and the upper housing comprises a step such that the digital band connector is fixed to the step.

The receptacle further includes rubber rings provided along the steps of the lower housing and the upper housing.

In accordance with an aspect of the present invention, there is provided a connector assembly, including: a digital band connector including a plurality of connect pins spaced apart from each other in a direction to fix digital bands made of a plurality of digital yarns and to be electrically connected with the digital bands; a lower housing fixing the digital bands and the connect pins in a lower part and exposing one end of each of the connect pins through a lower surface; and an upper housing coupled with an upper part of the lower housing to fix the digital bands and the connect pins; and a receptacle including a plurality of conductive patterns, each one end of which is connected to an external circuit and the other ends of which are electrically connected to the connect pins; a lower housing having a plurality of through holes penetrated by the other ends of the conductive patterns to support the other ends of the conductive patterns from a lower part; and an upper housing coupled with an upper part of the lower housing to define a space, in which the digital band connector is positioned, between the upper housing and the lower housing.

The connect pins of the digital band connector are connected to the digital yarns to correspond to the digital yarns and are electrically connected to metal units formed in the digital yarns.

One of the upper housing or the lower housing of the digital band connector includes at least one protrusion formed on a surface of the lower housing or the upper housing that contacts the digital bands.

The digital band connector further includes coupling jaws formed in the lower housing and the upper housing, and the receptacle includes steps formed in the lower housing and the upper housing so that the coupling jaws are fixed to the steps.

The receptacle further includes rubber rings provided along the steps.

Advantageous Effects

As described above, in the digital band connector, the receptacle, and the connector assembly according to the present invention, connect pins are provided in the digital band connector so that the connect pins are electrically connected to the digital yarns while fixing the digital yarns of the digital bands and are connected to the conductive patterns electrically connected to the external circuit of the receptacle. Therefore, the external circuit and the digital bands can be easily electrically connected to each other.

DESCRIPTION OF DRAWINGS

The above and other objects and features of the present invention will become apparent from the following description of embodiments given in conjunction with the accompanying drawings, in which.

Figure 1:
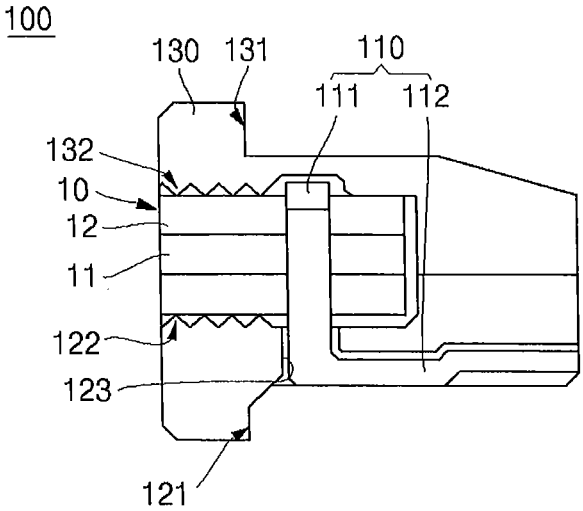
FIG. 1 is a sectional view illustrating a digital band connector according to an embodiment of the present invention.

[Description of Reference Numerals for Main Components of the Drawings]

| | |
|---|---|
| 10: digital band | 11: metal unit |
| 12: coating unit | 13: covering unit |
| 100: digital band connector | 110: connect pin |
| 111: piercing unit | 112: extending unit |
| 120: lower housing | 121: coupling jaw |
| 122: protrusion | 123: through hole |
| 130: upper housing | 131: coupling jaw |
| 132: protrusion | 200: receptacle |
| 210: conductive pattern | 220: lower housing |
| 230: upper housing | 240: rubber ring |

BEST MODE

Hereinafter, embodiments of the present invention will be described in detail with reference to the accompanying drawings so that they can be readily implemented by those skilled in the art.

Hereinafter, the structure of a digital band connector 100 according to an embodiment of the present invention will be described.

Figure 2:
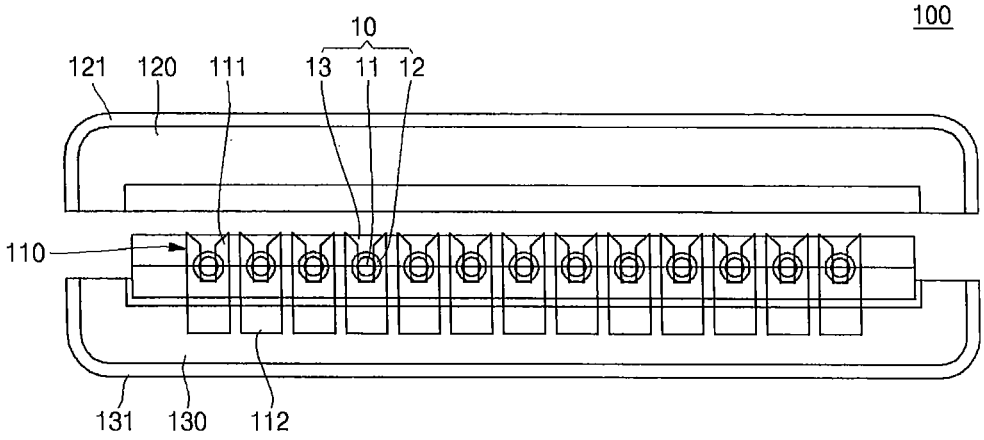
FIG. 2 is an exploded perspective view illustrating the digital band connector according to the embodiment of the present invention.
Figure 3:
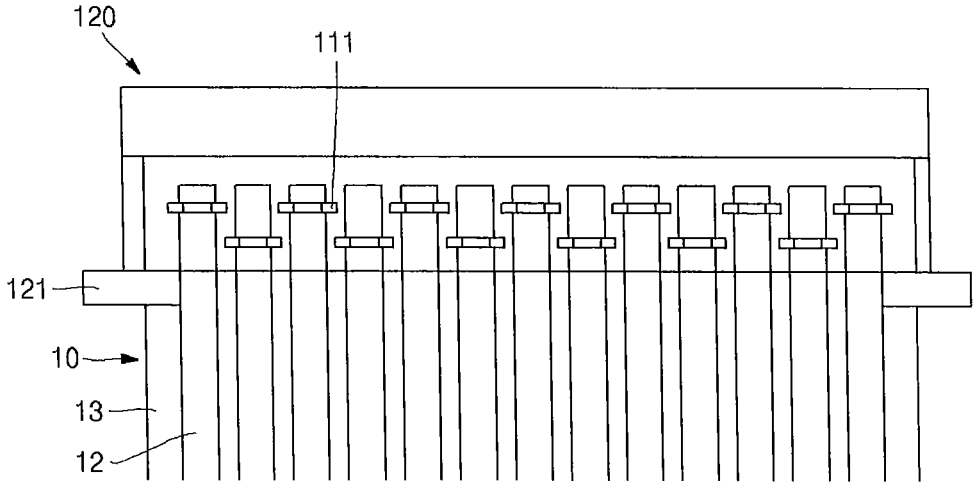
FIG. 3 is a plan view illustrating connect pins and a lower housing that are employed in the digital band connector according to the embodiment of the present invent.
Figure 4:
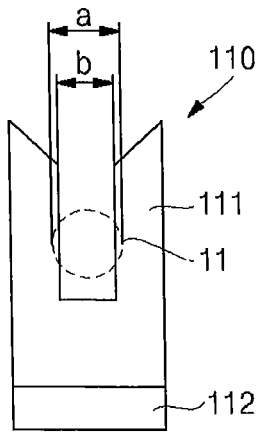
FIGS. 4 and 5 are a front view and a side view respectively illustrating the connect pin employed in the digital band connector according to the embodiment of the present invention.
Figure 5:
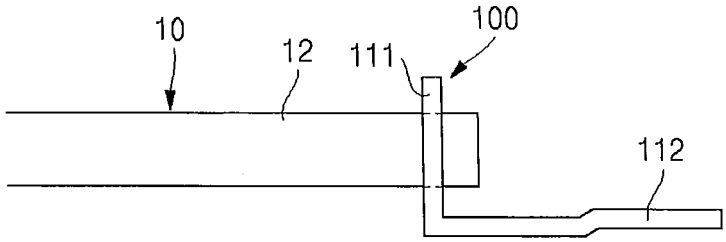

FIG. 1 is a sectional view illustrating the digital band connector 100 according to an embodiment of the present invention. FIG. 2 is an exploded perspective view illustrating the digital band connector 100 according to the embodiment of the present invention. FIG. 3 is a plan view illustrating connect pins 110 and a lower housing 120 that are employed in the digital band connector 100 according to the embodiment of the present invention. FIG. 4 is a front view illustrating the connect pin 110 employed in the digital band connector 100 according to the embodiment of the present invention. FIG. 5 is a side view illustrating the connect pin 110 employed in the digital band connector 100 according to the embodiment of the present invention.

Referring to FIGS. 1 to 5, a digital band connector 100 according to an embodiment of the present invention includes connect pins 110 fixing digital bands 10, a lower housing 120 supporting the connect pins 110 from a lower part, and an upper housing 130 coupled with the upper part of the lower housing 120.

First, the digital bands 10 employed in the digital band connector 100 according to the embodiment of the present invention include a plurality of metal units 11, coating units 12 surrounding the metal units 11, and covering units 13 binding the coating units 12. The metal units 11 and the coating units 12 form digital yarns constituting the digital bands 10.

The metal units 11 are made of a material having small electric resistance and high elastic recovery force against repeated bending. The metal units 11 may be made of copper, copper alloy, silver, silver alloy, brass, and equivalents of the above materials.

The coating units 12 block external noise so that may be used for high speed communications. Polyurethane or Teflon based material may be used as the coating units 12.

The covering units 13 are formed to surround the coating units 12. The covering units 13 bind the plurality of digital yarns. The covering units 13 may be tapes. The covering units 13 may be made of fabrics woven together with the digital yarns.

The connect pins 110 are provided and arranged by a distance in a direction. The connect pins 110 may be in zigzag fashion in the longitudinal direction of the digital band connector 100 according to the embodiment of the present invention or may be arranged in a line (not shown). The connect pins 110 pass through the digital bands 10 to fix the positions of the digital bands 10. The connect pins 110 pass through the respective digital yarns of the digital bands 10, respectively. That is, the lower housing 120 fixes the metal units 11 and the coating units 12 that form the digital yarns so that the digital bands 10 are fixed.

The connect pins 110 include piercing units 111 fixing the metal units 11 and extending units 112 extended from the piercing units 111.

Each of the piercing units 111 includes two vertical columns that pass through diametric ends of the metal unit 11. That is, the piercing unit 111 fixes the metal unit 11 when the metal unit 11 is inserted between the neighboring two columns.

In addition, the distance b between the neighboring two vertical columns of the piercing unit 111 is shorter than the diameter a of the metal unit 11. This is because the digital bands 10 include the coating units 12 provided in the outside of the metal units 11 and the piercing units 111 are electrically connected to the metal units 11 when the coating units 12 are removed. That is, the piercing units 111 contact the metal units 11 and are electrically connected the metal units 11 when the coating units 12 are removed by the two vertical columns.

The extending units 112 extend from the piercing units 111. The extending units 112 are perpendicular to the piercing units 111 and are formed in the longitudinal direction of the digital bands 10. Parts of the extending units 112 are formed along the lower surface of the lower housing 120 to be exposed to the outside. Therefore, the connect pins 110 are exposed through the extending units 112 and are electrically connected to the receptacle 200.

The lower housing 120 made of an insulator is coupled with the upper housing 130 to surround the ends of the digital bands 10. To this end, the lower housing 120 is longitudinally formed in the width direction of the digital bands 10 and in the direction where the connect pins 110 are arranged.

The lower housing 120 may have coupling jaws 121 that protrudes by a preset height from the end opposite an end to be coupled with the receptacle 200. Therefore, the coupling jaws 121 are locked to the receptacle 200 so that the lower housing 120 may be easily coupled with the receptacle 200.

The lower housing 120 may include a plurality of saw-toothed protrusions 122 formed on a part where the lower housing 120 contacts the digital bands 10. The protrusions 122 increase the contact area between the lower housing 120 and the digital bands 10, so that the digital bands 10 may be more firmly fixed.

In addition, the lower housing 120 includes through holes 123 formed in the lower surface. The through holes 123 pass through the lower housing 120 in the positions corresponding to the connect pins 110. Therefore, the connect pins 110 may pass through the lower surface of the lower housing 120 through the through holes 123.

The upper housing 130 is coupled with the lower housing 120 to surround the ends of the digital bands 10. The upper housing 130 is made of an insulator and is positioned on the lower housing 120.

The upper housing 130 may have coupling jaws 131 that protrude by a preset height from the end opposite to an end coupled with the receptacle 200. The coupling jaws 131 correspond to the coupling jaws 121 of the lower housing 120 and may be positioned in the same vertical line. The coupling jaws 131 are locked to the receptacle 200 so that the upper housing 130 may be coupled with the receptacle 200.

The upper housing 130 may have a plurality of protrusions 132 formed on the surface that contacts the digital bands 10. Therefore, the protrusions 132 increases the contact area with the digital bands 10, so that the digital bands 10 are firmly fixed.

As described above, the digital band connector 100 according to the embodiment of the present invention fixes the metal units 11 that form the digital yarns of the digital bands 10 with the connect pins 110 so that the connect pins 110 are electrically connected to the metal units 11. The connect pins 110 are exposed through the lower part of the lower housing 120. Therefore, by doing so, the digital band connector 100 according to the embodiment of the present invention may fix the digital bands 10 and may be easily coupled with the receptacle 200 so that the digital band connector 100 may be applied to a product.

Hereinafter, the structure of the receptacle 200 according to the embodiment of the present invention will be described.

Figure 6:
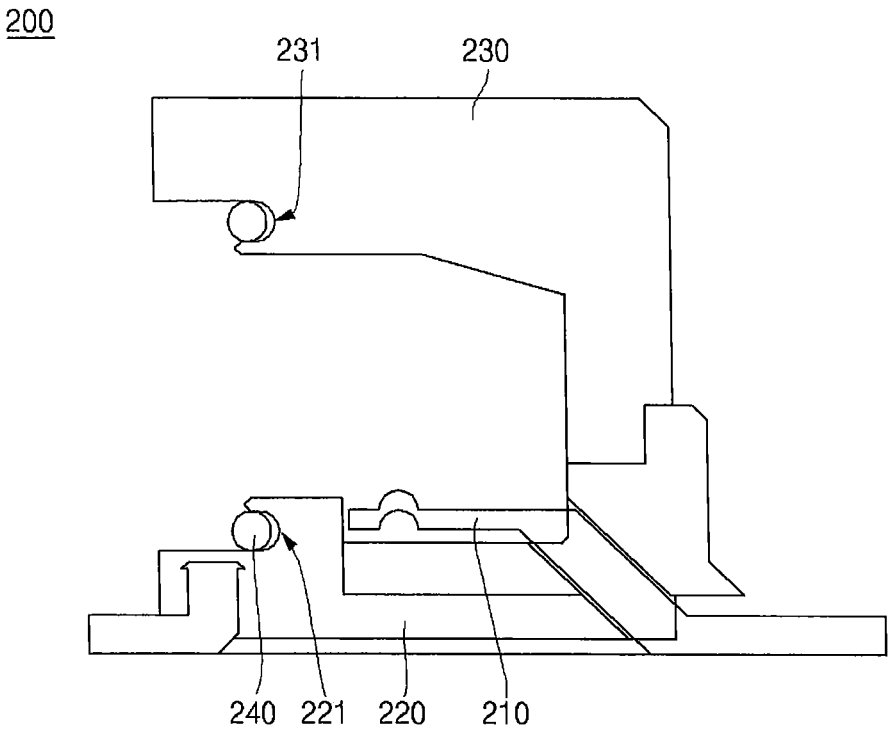
FIG. 6 is a sectional view illustrating a receptacle according to the embodiment of the present invention.

FIG. 6 is a sectional view illustrating the receptacle 200 according to the embodiment of the present invention.

As illustrated in FIG. 6, the receptacle 200 according to the embodiment of the present invention includes conductive patterns 210, a lower housing 220 surrounding the conductive patterns 210, and an upper housing 230 coupled with the lower housing 220 to define a space, in which the digital band connector 100 is coupled. The lower housing 220 and the upper housing 230 of the receptacle 200 according to the embodiment of the present invention may be integrated with each other and may further include rubber rings 240 provided on one surface of the lower housing 220 and the upper housing 230.

One end of each the conductive patterns 210 is connected to an external circuit (not shown) and the other ends of the conductive patterns 210 pass through the lower housing 220 from the lower part to the upper part. That is, the other ends of the conductive patterns 210 are formed on the upper surface of the lower housing 220. Therefore, the conductive patterns 210 may be electrically connected to the connect pins 110 of the digital band connector 100 according to the embodiment of the present invention. As a result, the digital bands 10 may be electrically connected to the external circuit through electric paths formed by the conductive patterns 210 and the connect pins 110 of the digital band connector 100.

The lower housing 220 is made of an insulator and is penetrated by the conductive patterns 210. The lower housing 220 has a step 221 formed on the end coupled with the digital band connector 100. Therefore, when the digital band connector 100 is coupled with the receptacle 200, the step 221 may be coupled with the coupling jaws 121 of the lower housing 120 provided in the digital band connector 100. the surface of the step 221 includes a curvature such that the rubber rings 240 may be easily coupled.

The upper housing 230 is coupled with the lower housing 220 to define a space, in which the digital band connector 100 is coupled. The upper housing 230 has a step 231 formed on the end coupled with the digital band connector 100. As a result, the coupling jaws 131 of the upper housing 130 provided in the digital band connector 100 may be coupled with the step 231. The surface of the step 231 includes a curvature such that the rubber rings 240 may be easily coupled.

The rubber rings 240 are provided along the step 221 of the lower housing 220 and the step 231 of the upper housing 230. That is, the rubber rings 240 are provided in the steps 221 and 231, in which the receptacle 200 directly contacts the digital band connector 100. The digital band connector 100 and the receptacle 200 may closely contact each other and may be coupled with each other through the rubber ring 240. Therefore, the rubber ring 240 prevents moisture from permeating the contact surface between the digital band connector 100 and the receptacle 200 to guarantee the stable operation of a product.

As described above, the receptacle 200 according to the embodiment of the present invention includes the space, in which the digital band connector 100 is coupled with the lower housing 220 and the upper housing 230, and the rubber rings 240 so that the digital band connector 100 may be firmly closely coupled. The receptacle 200 according to the embodiment of the present invention includes the conductive patterns 210 such that the connect pins 110 may be electrically connected to the external circuit.

Hereinafter, a connector assembly 1000 according to the embodiment of the present invention will be described.

Figure 7:
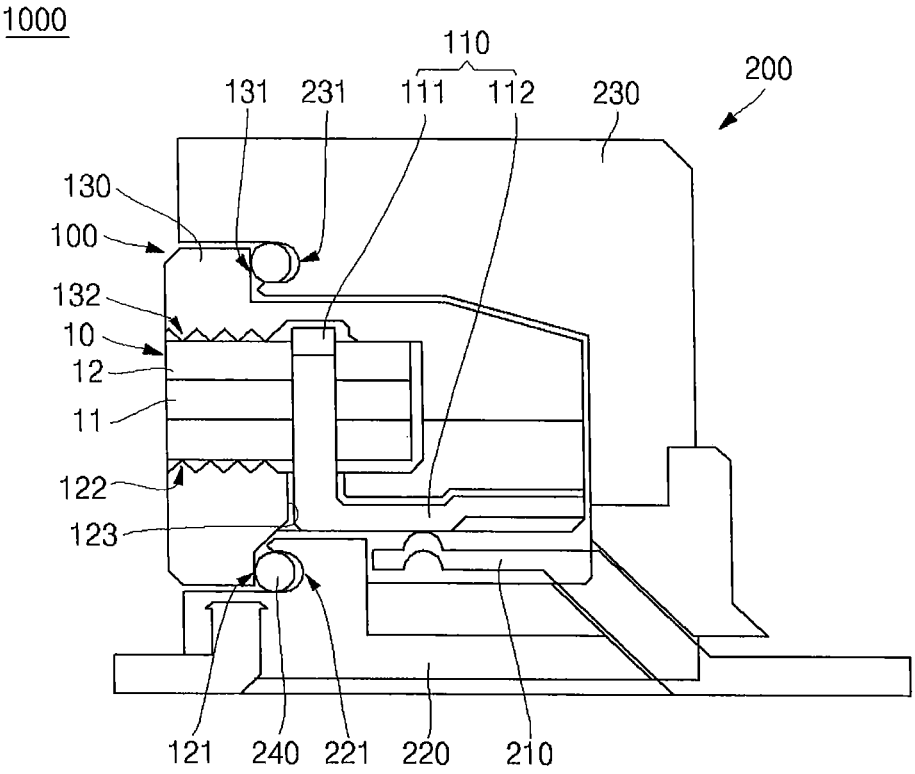
FIG. 7 is a sectional view illustrating a connector assembly formed by combining the digital band connector with the receptacle according to the embodiment of the present invention.

FIG. 7 is a sectional view illustrating a connector assembly 1000 according to the embodiment of the present invention.

Referring to FIG. 7, the connector assembly 1000 according to the embodiment of the present invention is formed by coupling the connector 100 with the receptacle 200.

The connector assembly 1000 according to the embodiment of the present invention includes the connect pins 110 of the digital band connector 100 to fix the digital bands 10 and to be electrically connected to the metal units 11 of the digital bands 10. The connect pins 110 are electrically connected to the conductive patterns 210 electrically connected to the external circuit of the receptacle 200. Therefore, the connector assembly 1000 according to the embodiment of the present invention lets the digital bands 10 enables the digital bands 10 to be easily connected to the external circuit and provides a path through which electric signals may be transmitted.

This work was supported by the IT R&D program of Ministry of Knowledge Economy (MKE) and Institute of Information Technology Assessment (IITA) of Republic of Korea [2006-S-029-02, Design and Development of Woven Ubiquitous Fashionable Computer (UFC) technology].

While the invention has been shown and described with respect to the preferred embodiments, it will be understood by those skilled in the art that various changes and modifications may be made without departing from the spirit and scope of the invention as defined in the following claims.

The invention claimed is:

1. A connector for digital bands, comprising:

a plurality of connect pins spaced apart from each other in a direction, passing through the digital band made of a plurality of digital yarns to fix the digital bands, and electrically connected with the digital bands;

a lower housing that fixes the digital bands and the connect pins to a lower part with one end of each of the connect pins exposed through a lower surface;

an upper housing coupled with an upper part of the lower housing to fix the digital bands and the connect pins; and wherein the lower housing comprises an exposed planar bottom surface, and wherein the connect pins comprise a bottommost surface coplanar with the bottom surface of the lower housing.

2. The connector of claim 1, wherein the connect pins correspond to the digital yarns to be connected to the digital yarns and are electrically connected to metal units formed in the digital yarns.

3. The connector of claim 1, wherein the connect pins further comprise piercing units fixing the digital yarns and extending units connected to the piercing units to be extended to the outside of the lower housing.

4. The connector of claim 3, wherein each of the piercing units comprises two vertical columns such that the digital yarns are inserted there between to fix the digital yarns.

5. The connector of claim 4, wherein a distance between the columns is shorter than a cross-sectional diameter of the metal units of the digital yarns.

6. The connector of claim 1, wherein the connect pins are arranged in zigzag fashion.

7. The connector of claim 1, wherein each of the digital bands is made by taping upper and lower ends of the plurality of digital yarns or by combining the same with fabrics.

8. The connector of claim 1, wherein one of the lower housing and the upper housing further comprises at least one protrusion formed on a surface of the lower housing or the upper housing to be coupled with the digital bands.

9. The connector of claim 1, wherein the lower housing comprises through holes in a lower part thereof so that the connect pins penetrate the through holes and are exposed to a lower surface of the lower housing through the through holes.

10. The connector of claim 1, wherein the lower housing comprises an exposed planar rearward surface, and wherein the connect pins comprise a terminal end aligned with the rearward surface of the lower housing.

11. A receptacle, comprising:

a plurality of conductive patterns, each one end of which is connected to an external circuit, and an entirety of a structure for each conductive pattern comprising a single and continuous structure with each one end exposed and spaced from the receptacle;

a lower housing including a plurality of through holes penetrated by the other ends of the conductive patterns to support the other ends of the conductive patterns from a lower part of the lower housing;

an upper housing coupled with an upper part of the lower housing to define a space between the upper housing and the lower housing;

wherein a digital band connector connected to digital bands is inserted into the space so that the digital band connector is electrically connected to the conductive patterns; and wherein the lower housing comprises a bottommost surface and wherein the conductive patterns comprise a bottommost surface coplanar with the bottommost surface of the lower housing.

12. The receptacle of claim 11, wherein each of the lower housing and the upper housing comprises a step such that the digital band connector is fixed to the step.

13. The receptacle of claim 12, further comprising rubber rings provided along the steps of the lower housing and the upper housing.

14. The receptacle of claim 11, wherein each of the conductive patterns extends horizontally outside of the lower housing.

15. A connector assembly, comprising:

a digital band connector including:

a plurality of connect pins spaced apart from each other in a direction to fix digital bands made of a plurality of digital yarns and to be electrically connected with the digital bands;

a lower housing that fixes the digital bands and the connect pins in a lower part with one end of each of the pins exposed through a lower surface; and an upper housing coupled with an upper part of the lower housing to fix the digital bands and the connect pins; and a receptacle including:

a plurality of conductive patterns, each one end of which is connected to an external circuit and the other ends of which are electrically connected to the connect pins;

a lower housing having a plurality of through holes penetrated by the other ends of the conductive patterns to support the other ends of the conductive patterns from a lower part; and an upper housing coupled with an upper part of the lower housing to define a space, in which the digital band connector is positioned, between the upper housing and the lower housing.

16. The connector assembly of claim 15, wherein the connect pins of the digital band connector are connected to the digital yarns to correspond to the digital yarns and are electrically connected to metal units formed in the digital yarns.

17. The connector assembly of claim 15, wherein one of the upper housing or the lower housing of the digital band connector comprises at least one protrusion formed on a surface of the lower housing or the upper housing that contacts the digital bands.

18. The connector assembly of claim 15, wherein the digital band connector further comprises coupling jaws formed in the lower housing and the upper housing, and the receptacle comprises steps formed in the lower housing and the upper housing so that the coupling jaws are fixed to the steps.

19. The connector assembly of claim 18, wherein the receptacle further comprises rubber rings provided along the steps.

20. The connector assembly of claim 15, wherein each one of the conductive patterns comprises an arcuate portion in direct contact with each one of the connect pins.

* * * * *